United States Patent [19]

Lemire

[11] 4,375,924

[45] Mar. 8, 1983

[54] PASTE DISPENSER TOOTH-BRUSH

[76] Inventor: Paul-Emile Lemire, 59-2nd Ave., P.O. Box 823, Forestville, Quebec, Canada, G0T 1E0

[21] Appl. No.: 292,613

[22] Filed: Aug. 13, 1981

[51] Int. Cl.[3] ..... A46B 11/02

[52] U.S. Cl. ..... 401/173; 401/174; 401/279; 401/287

[58] Field of Search ..... 401/172, 173, 174, 279, 401/287

[56] References Cited

U.S. PATENT DOCUMENTS

| | | | |
|---|---|---|---|
| 1,973,158 | 9/1934 | Small et al. | 401/173 |
| 2,287,321 | 6/1942 | Mureau | 401/174 |
| 2,621,352 | 12/1952 | Speig | 401/173 |
| 3,738,761 | 6/1973 | Hard | 401/173 |

FOREIGN PATENT DOCUMENTS

| | | | |
|---|---|---|---|
| 733701 | 7/1932 | France | 401/172 |
| 356541 | 9/1931 | United Kingdom | 401/173 |

*Primary Examiner*—Steven A. Bratlie

[57] ABSTRACT

A paste dispenser tooth-brush that is convenient and simple to operate and is adapted to be conveniently carried on a person. This paste dispenser tooth-brush comprises an intermediate tubular body, a tooth-brush head secured at one end of the intermediate body, a tooth-paste supply cartridge at the other end of the intermediate body, a cover fitting over the tooth-brush with a tooth-paste axial passage in the intermediate body, the latter forming a piston at one end screwing in the tooth-paste supply cartridge to expel the tooth-paste toward the tooth-brush through the axial passage, and an apertured cap at the open end of the cartridge and screwed and unscrewed by the piston to either expel the tooth-paste or to open the cartridge for refill.

1 Claim, 7 Drawing Figures

Fig. 5
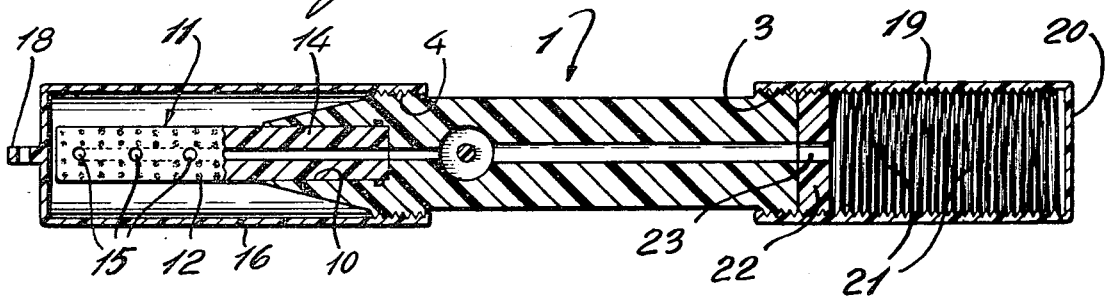
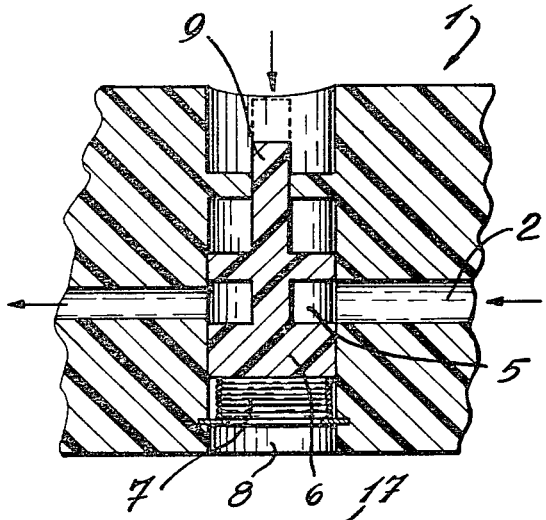
Fig. 6
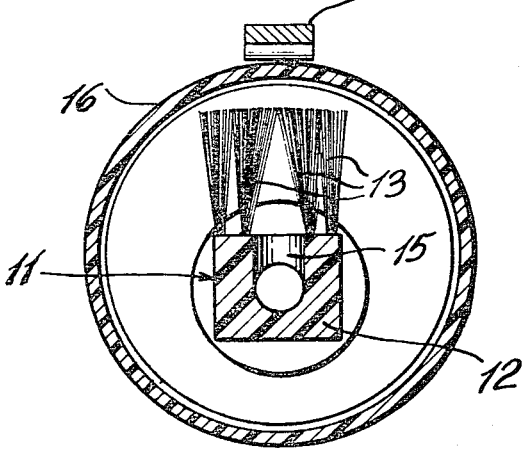
Fig. 7

PASTE DISPENSER TOOTH-BRUSH

This invention relates to a tooth-brush of the type adapted to dispense the tooth-paste to the bristles of the tooth-brush head.

The term tooth-brush head is used here to define the bristles and the body on which the bristles are secured.

It is a general object of the present invention to provide a paste dispenser tooth-brush of convenient and simple construction and operation.

It is another object of the present invention to provide a paste dispenser tooth-brush that is adapted to be conveniently carried by a person either clipped to one's pocket or suspended to one's neck by a chain or string.

It is a further object of the present invention to provide a paste dispenser tooth-brush wherein the tooth-brush is dispensed from a container or cartridge that may be refilled from a conventional tooth-paste tube or may be readily replaced by a refill cartridge.

The invention will now be described in detail with reference to a specific embodiment thereof which is illustrated, by way of example, in the accompanying drawings, in which:

FIG. 5 is a longitudinal cross-section through the same tooth-brush but at 90° compared to the cross-section of FIG. 3;

FIG. 6 is an enlarged detail view of a portion of FIG. 3, particularly illustrating a paste control valve; and FIG. 7 is a transverse cross-sectional view as seen along line 7—7 in FIG. 3.

Figure 1:
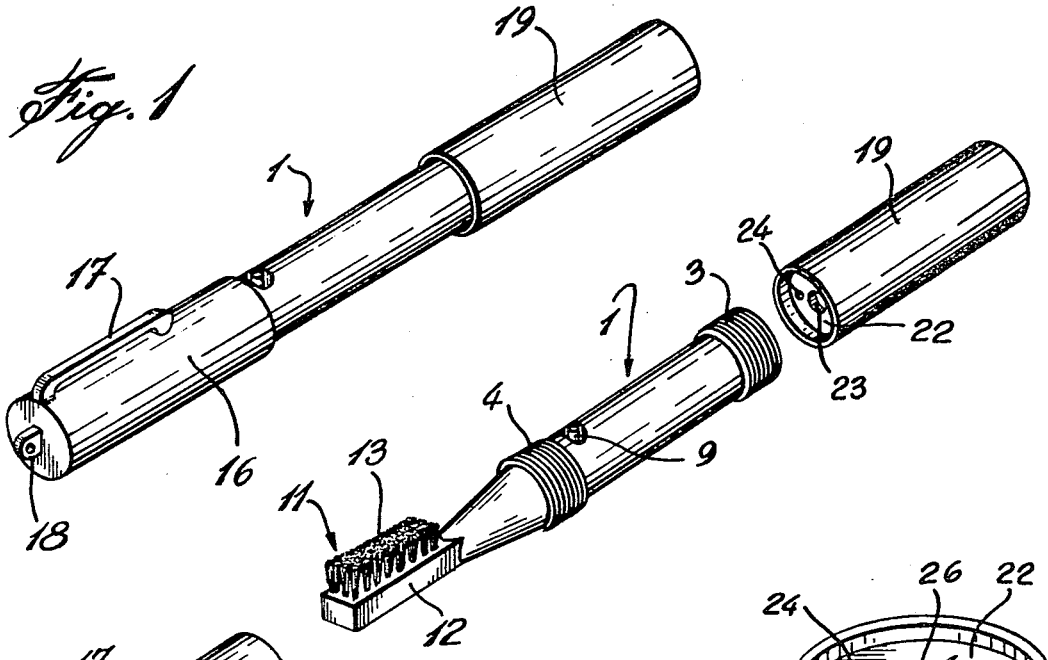
FIG. 1 is a perspective view of a paste dispenser tooth-brush according to the present invention and shown in closed position.
Figure 2:
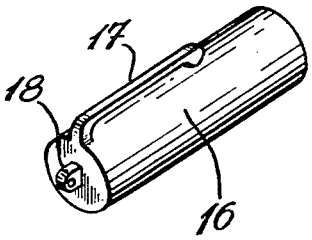
FIG. 2 is an exploded perspective view of the same paste dispenser tooth-brush.
Figure 4:
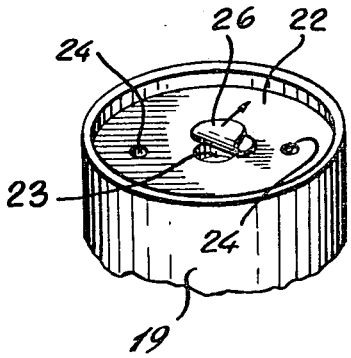
FIG. 4 is a perspective view of one end of a tooth-paste supply cartridge forming part of the same paste dispenser tooth-brush.
Figure 3:
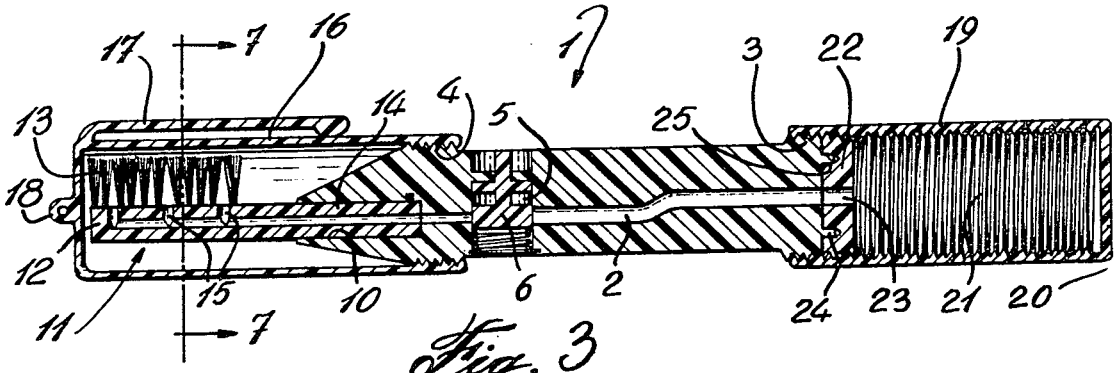
FIG. 3 is a longitudinal cross-section through the same paste dispenser tooth-brush.

The illustrated paste dispenser tooth-brush comprises an intermediate body 1, of generally cylindrical shape, defining an internal longitudinal or axial passage 2 extending from end to end thereof for the passage of tooth-paste. The intermediate body 1 is provided with external screw threads 3 and 4 on its opposite ends respectively. The intermediate body 1 is also provided with a radial bore extending therethrough and forming a valve chamber 5 intercepting the axial tooth-paste passage 2. A valve member 6 is slidable axially in the valve chamber to selectively intercept the flow of tooth-paste along the tooth-paste passage 2. A spring 7 biases the tooth-paste control valve 6 toward its closing position and is held captive by a cap or plug 8. The valve member 6 includes a projection 9 to be pushed down to open the tooth-paste control valve. The end of the intermediate body 1 which is provided with the external screw threads 4 is formed with an axial recess 10.

A tooth-brush head 11 is attached to the intermediate body 1 and comprises an elongated body 12 and tooth-brush bristles 13. The elongated body 12 has a shank portion 14 secured endwise into the axial cavity 10 in the end of the intermediate body 1. The tooth-brush body 12 is provided with tooth-paste outlet ports 15 in communication through the shank 14 with the tooth-paste passage 2 in the intermediate body 1.

A cover, or cap 16, is screwed over the tooth-brush head 11 by engagement with the external screw threads 4. The cover 16 is provided with a pocket attachment clip 17 and an apertured lug or eye 18 for carrying of the tooth-brush in one's pocket or suspended by a chain or string.

At the other end of the intermediate body 1, there is provided a tooth-paste supply holder in the form of a cap or cartridge 19. The cartridge 19 has a closed end 20 and an axially opposite open end with internal screw threads 21 extending throughout the length thereof. A cap, or plug 22, is provided with external screw threads to be screwed into the cartridge 19 and close the same. The cap, or plug 22, is provided with an axial paste outlet hole, or passage 23, through which the tooth-paste will be expelled. A pair of recesses, or cavities 24, are provided in the cap or plug 22. The corresponding end of the intermediate body 1 is provided with a pair of projections, or pins 25, registering with the cavities 24 to engage in the latter for bodily rotation of the cap or plug 22 with the intermediate body 1 relative to the cartridge 19.

It will be noted that the cartridge 19 forms a cylindrical tooth-paste chamber with its internal screw threads cooperating with the external screw threads 3 to form a screw-threaded connection between the cartridge or cap 19 and the intermediate body 1. This screw-threaded connection is used to secure the cartridge 19 on the end of the intermediate body and it is also advantageously used to expel the tooth-paste out of the cartridge through the communicating passage defined by the elements 23, 2, 15. This is done by screwing in the screw threads 3 and the plug 22 bodily therewith to force the tooth-paste out through the central outlet 23 in the plug. Thus, the corresponding end of the intermediate body acts as a piston in cooperation with the plug 22.

The cartridge, or cap 19, may be refilled by the user by unscrewing the plug 22 and using, say, a conventional tooth-paste tube. The cartridge 19 may also be discarded when empty to be replaced by a full cartridge sold for that purpose, such as with a pull-off sticker 26, to close the outlet 23 pending its use.

I claim:

1. A paste dispenser tooth-brush comprising, in combination, an intermediate body with a tooth-paste passage therein, a tooth-brush head secured to one end of the intermediate body and including a tooth-brush with an intermediate passage and with paste outlet means in operative communication with the tooth-paste passage of the intermediate body, the other end of said intermediate body forming an integral piston having external screw threads, the tooth-paste passage of said intermediate body opening at the external end face of said piston, at least two spaced projections protruding from said end face of said piston, a tooth-paste supply cartridge having an open end and a closed opposite end, and having an internal surface forming internal screw threads extending substantially through the entire length of said cartridge, a rigid cap having external screw threads, a tooth-paste passage extending therethrough and spaced cavities at one end face, the external screw threads of said piston and cap engageable with the internal screw threads of said cartridge, said spaced cavities adapted to receive the projections of said piston with the tooth-paste passage of said cap in communication with the tooth-paste passage of said intermediate body, said cap closing the open end of said cartridge when the latter is filled with tooth-paste, a pull-off sticker closing the tooth-paste passage of said cap, removal of the latter enabling said piston to be inserted into the open end of said cartridge in threaded engagement with the internal threads thereof and with the projections of said piston engaging the cavities of said cap with the tooth-paste passage of said intermediate body in register with the tooth-paste passage of said cap and in communication with the supply of tooth-paste in said cartridge, relative rotation of said cartridge and of the assembly of said piston and of said cap in one direction causing expelling of the tooth-paste within said cartridge through said tooth-paste passages, and once the tooth-paste supply in said cartridge is spent, said cartridge can be detached from said piston by relative rotation of said cartridge with respect to the assembly of said piston and cap in the opposite direction.

* * * * *